US009025779B2

(12) United States Patent
Ramalho et al.

(10) Patent No.: US 9,025,779 B2
(45) Date of Patent: May 5, 2015

(54) SYSTEM AND METHOD FOR USING ENDPOINTS TO PROVIDE SOUND MONITORING

(75) Inventors: Michael A. Ramalho, Sarasota, FL (US); James C. Frauenthal, Colts Neck, NJ (US); Brian A. Apgar, San Jose, CA (US)

(73) Assignee: Cisco Technology, Inc., San Jose, CA (US)

( * ) Notice: Subject to any disclaimer, the term of this patent is extended or adjusted under 35 U.S.C. 154(b) by 505 days.

(21) Appl. No.: 13/205,368

(22) Filed: Aug. 8, 2011

(65) Prior Publication Data

US 2013/0039497 A1 Feb. 14, 2013

(51) Int. Cl.

| | |
|---|---|
| ***H04R 29/00*** | (2006.01) |
| ***G08B 13/16*** | (2006.01) |
| ***H04R 1/28*** | (2006.01) |
| ***H04R 5/02*** | (2006.01) |
| *H04R 1/02* | (2006.01) |
| *H04R 17/00* | (2006.01) |
| *H04R 27/00* | (2006.01) |
| *H04S 5/00* | (2006.01) |
| *G08B 13/196* | (2006.01) |

(52) U.S. Cl.

CPC ..... *G08B 13/1672* (2013.01); *H04R 1/2834* (2013.01); *H04R 5/02* (2013.01); *H04R 1/02* (2013.01); *H04R 17/00* (2013.01); *H04R 27/00* (2013.01); *H04S 5/00* (2013.01); *H04R 2205/022* (2013.01); *H04R 2217/01* (2013.01); *H04R 2227/003* (2013.01); *G08B 13/19697* (2013.01)

(58) Field of Classification Search

CPC ..... H04R 1/02; H04R 1/2834; H04R 5/02; H04R 17/00; H04R 27/00; H04R 2205/022; H04R 2217/01; H04R 2227/03; H04S 5/00; G08B 13/1672; G08B 13/19697

USPC ..... 381/56; 700/94; 340/541, 545.1–545.4, 340/552–554, 561, 565–567

See application file for complete search history.

(56) References Cited

U.S. PATENT DOCUMENTS

| | | | |
|---|---|---|---|
| 3,684,829 | A | 8/1972 | Patterson |
| 3,786,188 | A | 1/1974 | Allen |
| 4,199,261 | A | 4/1980 | Tidd et al. |
| 4,815,068 | A | 3/1989 | Dolby et al. |
| 4,815,132 | A | 3/1989 | Minami |
| 5,732,306 | A | 3/1998 | Wilczak, Jr. |
| 5,864,583 | A | 1/1999 | Ozkan |

(Continued)

OTHER PUBLICATIONS

Miercom, "Lab testing summary report", Dec. 2008, pp. 1-7; www.miercom.com.*

(Continued)

*Primary Examiner* — Vivian Chin
*Assistant Examiner* — David Ton
(74) *Attorney, Agent, or Firm* — Patent Capital Group

(57) ABSTRACT

A method is provided in one example embodiment that includes monitoring a sound pressure level with an endpoint (e.g., an Internet Protocol (IP) phone), which is configured for communications involving end users; analyzing the sound pressure level to detect a sound anomaly; and communicating the sound anomaly to a sound classification module. The endpoint can be configured to operate in a low-power mode during the monitoring of the sound pressure level. In certain instances, the sound classification module is hosted by the endpoint. In other implementations, the sound classification module is hosted in a cloud network.

20 Claims, 5 Drawing Sheets

(56) References Cited

U.S. PATENT DOCUMENTS

| | | | |
|---|---|---|---|
| 6,049,765 | A | 4/2000 | Iyengar et al. |
| 6,385,548 | B2 | 5/2002 | Ananthaiyer et al. |
| 6,453,022 | B1 | 9/2002 | Weinman, Jr. |
| 6,477,502 | B1 | 11/2002 | Ananthpadmanabhan et al. |
| 6,609,781 | B2 | 8/2003 | Adkins et al. |
| 6,675,144 | B1 | 1/2004 | Tucker et al. |
| 6,785,645 | B2 | 8/2004 | Khalil et al. |
| 6,823,303 | B1 | 11/2004 | Su et al. |
| 6,839,416 | B1 | 1/2005 | Shaffer |
| 6,842,731 | B2 | 1/2005 | Miseki |
| 7,043,008 | B1 | 5/2006 | Dewan |
| 7,130,796 | B2 | 10/2006 | Tasaki |
| 7,136,471 | B2 | 11/2006 | Johnson |
| 7,266,113 | B2 | 9/2007 | Wyatt |
| 7,369,652 | B1 | 5/2008 | Liang et al. |
| 7,392,189 | B2 | 6/2008 | Hennecke et al. |
| 7,539,615 | B2 | 5/2009 | Koistinen et al. |
| 7,852,999 | B2 | 12/2010 | Ramalho |
| 7,908,628 | B2 | 3/2011 | Swart et al. |
| 8,509,391 | B2 * | 8/2013 | Elliot et al. ..... 379/37 |
| 2004/0125001 | A1 | 7/2004 | Lotzer |
| 2004/0138876 | A1 | 7/2004 | Kallio et al. |
| 2005/0253713 | A1 * | 11/2005 | Yokota ..... 340/566 |
| 2006/0004579 | A1 * | 1/2006 | Claudatos et al. ..... 704/270 |
| 2006/0274901 | A1 * | 12/2006 | Terai et al. ..... 381/17 |
| 2008/0130908 | A1 * | 6/2008 | Cohen et al. ..... 381/71.1 |
| 2008/0240458 | A1 * | 10/2008 | Goldstein et al. ..... 381/72 |
| 2011/0003577 | A1 * | 1/2011 | Rogalski et al. ..... 455/404.1 |
| 2011/0082690 | A1 * | 4/2011 | Togami et al. ..... 704/201 |

OTHER PUBLICATIONS

Audio Analytic Ltd., "Sound Classification Technology," © 2011, 2 pages; http://www.audioanalytic.com/en/technology.

Alibaba.com, "The Telespy Intruder Alert telephone motion sensor microphone," © 1999-2010, 3 pages; http://www.alibaba.com/product-free/101669285/THE_TELESPY_INTRUDER_ALERT_telephone_motion.html.

Michael A. Casey, "Sound Classification and Similarity," 2002, 15 pages; http://xenia.media.mit.edu/~mkc/c19.pdf.

* cited by examiner

SYSTEM AND METHOD FOR USING ENDPOINTS TO PROVIDE SOUND MONITORING

TECHNICAL FIELD

This disclosure relates in general to acoustic analysis, and more particularly, to a system and a method for using endpoints to provide sound monitoring.

BACKGROUND

Acoustic analysis continues to emerge as a valuable tool for security applications. For example, some security platforms may use audio signals to detect aggressive voices or glass breaking. Much like platforms that rely on video surveillance, platforms that implement acoustic analysis typically require a remote sensor connected to a central processing unit. Thus, deploying a security system with an acoustic analysis capacity in a large facility (or public area) can require extensive resources to install, connect, and monitor an adequate number of remote acoustic sensors. Moreover, the quantity and complexity of acoustic data that should be processed can similarly require extensive resources and, further, can quickly overwhelm the processing capacity of a platform, as the size of a monitored area increases. Thus, implementing a security platform with the capacity to monitor and analyze complex sound signals, particularly in large spaces, continues to present significant challenges to developers, manufacturers, and service providers.

BRIEF DESCRIPTION OF THE DRAWINGS

To provide a more complete understanding of the present disclosure and features and advantages thereof, reference is made to the following description, taken in conjunction with the accompanying figures, wherein like reference numerals represent like parts, in which.

DETAILED DESCRIPTION OF EXAMPLE EMBODIMENTS

Overview

A method is provided in one example embodiment that includes monitoring a sound pressure level with an endpoint (e.g., an Internet Protocol (IP) phone), which is configured for communications involving end users; analyzing the sound pressure level to detect a sound anomaly; and communicating the sound anomaly to a sound classification module. The endpoint can be configured to operate in a low-power mode during the monitoring of the sound pressure level. In certain instances, the sound classification module is hosted by the endpoint. In other implementations, the sound classification module is hosted in a cloud network.

The method can also include accessing a sound database that includes policies associated with a plurality of environments in which a plurality of endpoints reside; and updating the sound database to include a signature associated with the sound anomaly. The method can also include evaluating the sound anomaly at the sound classification module; and initiating a response to the sound anomaly, where the response includes using a security asset configured to monitor the location associated with the sound anomaly and to record activity at the location. The sound anomaly can be classified based, at least in part, on an environment in which the sound anomaly occurred.

Example Embodiments

Figure 1:
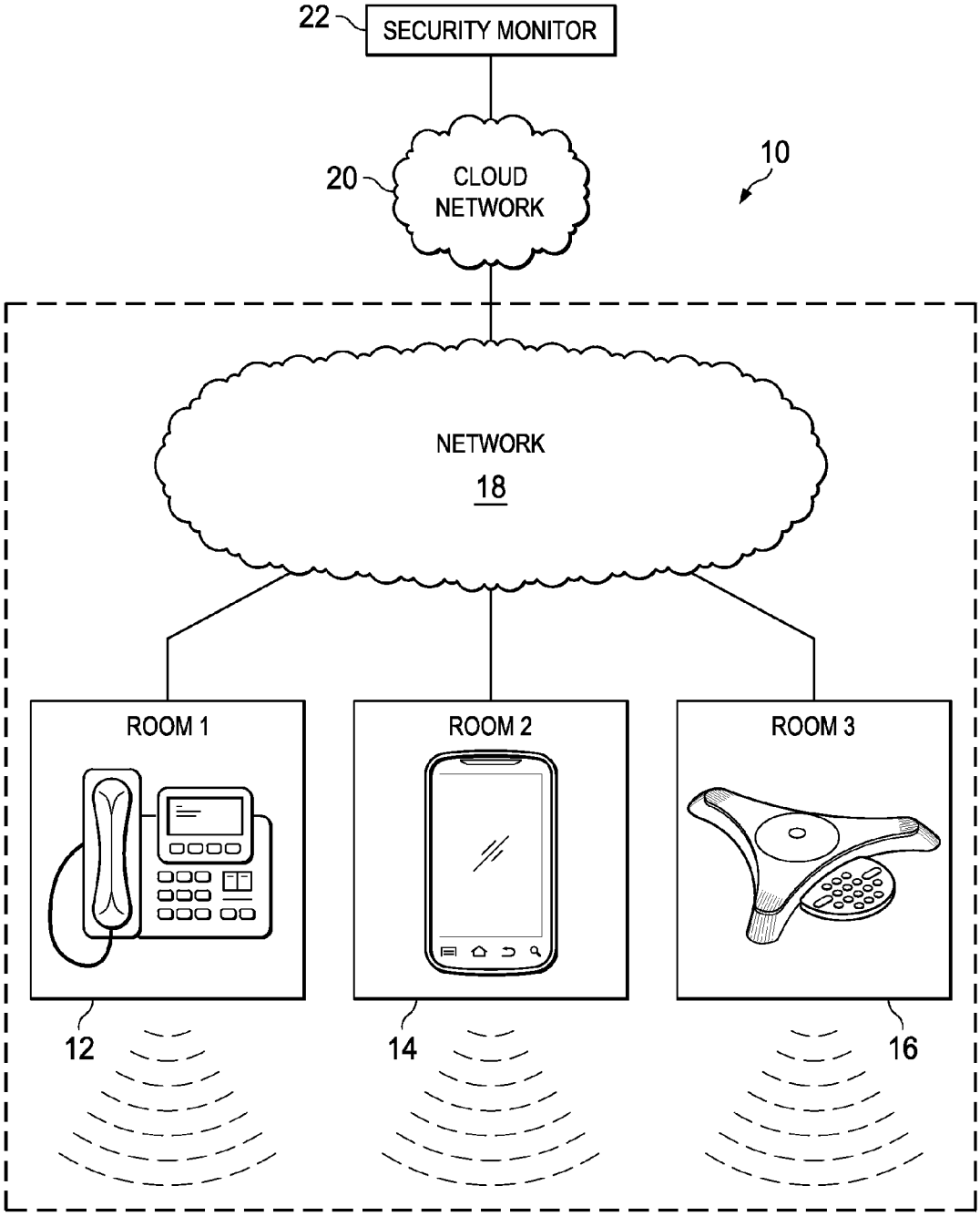
FIG. 1 is a simplified block diagram illustrating an example embodiment of a communication system according to the present disclosure.

Turning to FIG. 1, FIG. 1 is a simplified block diagram of an example embodiment of a communication system 10 for monitoring a sound pressure level (SPL) in a network environment. Various communication endpoints are depicted in this example embodiment of communication system 10, including an Internet Protocol (IP) telephone 12, a wireless communication device 14 (e.g., an iPhone, Android, etc.), and a conference telephone 16.

Communication endpoints 12, 14, 16 can receive a sound wave, convert it to a digital signal, and transmit the digital signal over a network 18 to a cloud network 20, which may include (or be connected to) a hosted security monitor 22. A dotted line is provided around communication endpoints 12, 14, 16, and network 18 to emphasize that the specific communication arrangement (within the dotted line) is not important to the teachings of the present disclosure. Many different kinds of network arrangements and elements (all of which fall within the broad scope of the present disclosure) can be used in conjunction with the platform of communication system 10.

In this example implementation of FIG. 1, each communication endpoint 12, 14, 16 is illustrated in a different room (e.g., room 1, room 2, and room 3), where all the rooms may be in a large enterprise facility. However, such a physical topology is not material to the operation of communication system 10, and communication endpoints 12, 14, 16 may alternatively be in a single large room (e.g., a large conference room, a warehouse, a residential structure, etc.).

In one particular embodiment, communication system 10 can be associated with a wide area network (WAN) implementation such as the Internet. In other embodiments, communication system 10 may be equally applicable to other network environments, such as a service provider digital subscriber line (DSL) deployment, a local area network (LAN), an enterprise WAN deployment, cable scenarios, broadband generally, fixed wireless instances, fiber to the x (FTTx), which is a generic term for any broadband network architecture that uses optical fiber in last-mile architectures. It should also be noted that communication endpoints 12, 14, 16 can have any suitable network connections (e.g., intranet, extranet, virtual private network (VPN)) to network 18.

Each of the elements of FIG. 1 may couple to one another through any suitable connection (wired or wireless), which provides a viable pathway for network communications. Additionally, any one or more of these elements may be combined or removed from the architecture based on particular configuration needs. Communication system 10 may include a configuration capable of transmission control protocol/Internet protocol (TCP/IP) communications for the transmission or reception of packets in a network. Communication system 10 may also operate in conjunction with a user datagram protocol/IP (UDP/IP) or any other suitable protocol where appropriate and based on particular needs.

Before detailing the operations and the infrastructure of FIG. 1, certain contextual information is provided to offer an overview of some problems that may be encountered in deploying a security system with acoustic analysis: particularly in a large enterprise facility, campus, or public area. Such information is offered earnestly and for teaching purposes only and, therefore, should not be construed in any way to limit the broad applications for the present disclosure.

Many facilities are unoccupied with relative inactivity during certain periods, such as nights, weekends, and holidays. During these inactive periods, a security system may monitor a facility for anomalous activity, such as unauthorized entry, fire, equipment malfunction, etc. A security system may deploy a variety of resources, including remote sensors and human resources for patrolling the facility and for monitoring the remote sensors. For example, video cameras, motion sensors, and (more recently) acoustic sensors may be deployed in certain areas of a facility. These sensors may be monitored in a secure office (locally or remotely) by human resources, by a programmable system, or through any suitable combination of these elements.

Sound waves exist as variations of pressure in a medium such as air. They are created by the vibration of an object, which causes the air surrounding it to vibrate. All sound waves have certain properties, including wavelength, amplitude, frequency, pressure, intensity, and direction, for example. Sound waves can also be combined into more complex waveforms, but these can be decomposed into constituent sine waves and cosine waves using Fourier analysis. Thus, a complex sound wave can be characterized in terms of its spectral content, such as amplitudes of the constituent sine waves.

Acoustic sensors can measure sound pressure or acoustic pressure, which is the local pressure deviation from the ambient atmospheric pressure caused by a sound wave. In air, sound pressure can be measured using a microphone, for example. SPL (or "sound pressure level") is a logarithmic measure of the effective sound pressure of a sound relative to a reference value. It is usually measured in decibels (dB) above a standard reference level. The threshold of human hearing (at 1 kHz) in air is approximately 20 μPa RMS, which is commonly used as a "zero" reference sound pressure. In the case of ambient environmental measurements of "background" noise, distance from a sound source may not be essential because no single source is present.

Thus, security monitors can analyze data from acoustic sensors to distinguish a sound from background noise, and may be able to identify the source of a sound by comparing the sound signal to a known sound signature. For example, an HVAC system may produce certain sounds during inactive periods, but these sounds are normal and expected. A security monitor may detect and recognize these sounds, usually without triggering an alarm or alerting security staff.

However, deploying a security system with acoustic analysis capabilities in a large facility or public area can require extensive resources to install, connect, and monitor an adequate number of acoustic sensors. Moreover, the quantity and complexity of audio data that must be processed can likewise require extensive resources and, further, can quickly overwhelm the processing capacity of a platform as the size of a monitored area increases.

On a separate front, IP telephones, videophones, and other communication endpoints are becoming more commonplace: particularly in enterprise environments. These communication endpoints typically include both an acoustic input component (e.g., a microphone) and signal processing capabilities. Many of these communication endpoints are 16-bit capable with an additional analog gain stage prior to analog-to-digital conversion. This can allow for a dynamic range in excess of 100 dB and an effective capture of sound to within approximately 20 dB of the threshold of hearing (i.e., calm breathing at a reasonable distance). During inactive periods, when security systems are typically engaged, communication endpoints may be configured for a low-power mode to conserve energy.

However, even in a low-power mode, these endpoints consume enough power to keep some components active. Some of these types of devices can be powered over Ethernet with much of the power needs being used by the acoustic or optical output devices (i.e., speaker or display). The acoustic input portions and digital signal processing (DSP) portions of these devices typically require only a small fraction of the power required during normal use and, further, can remain active even in a low-power mode.

In accordance with one embodiment, communication system 10 can overcome some of the aforementioned shortcomings (and others) by monitoring SPL through communication endpoints. In more particular embodiments of communication system 10, SPL can be monitored through communication endpoints during inactive periods, while the endpoints are in a low-power mode, where actions may be taken if an anomalous sound is observed.

A sound anomaly (or anomalous sound), as used herein, may refer to a sound that is uncharacteristic, unexpected, or unrecognized for a given environment. For example, an uninhabited office space may have a nominal SPL of 15 dBA, but may experience HVAC sounds that exceed that level when an air conditioning unit operates. The sound of the air conditioner is probably not an anomalous sound—even though it exceeds the nominal SPL—because it may be expected in this office space. Equipment such as an air compressor in a small factory may be another example of an expected sound exceeding a nominal SPL.

Thus, not all sounds in excess of the background acoustic nominal SPL in an environment are necessarily anomalous, and communication system 10 may intelligently classify sounds to distinguish anomalous sounds from expected sounds. In certain embodiments, for example, an endpoint such as IP telephone 12 can monitor SPL and classify sounds that exceed the background noise level (i.e., the nominal SPL). In other embodiments, an endpoint can monitor SPL, pre-process and classify certain sounds locally (e.g., low-complexity sounds), and forward other sounds to a remote (e.g., cloud-based) sound classification module. This could occur if, for example, a sound has a particularly complex signature and/or an endpoint lacks the processing capacity to classify the sound locally.

A sound classification module (or "engine") can further assess the nature of a sound (e.g., the unanticipated nature of the sound). Such a module may learn over time which sounds are expected or typical for an environment (e.g., an air compressor sound in one location may be expected, while not in a second location). Some sounds, such as speech, can be readily classified. Over time, a sound classification module can become quite sophisticated, even learning times of particular expected sound events, such as a train passing by at a location near railroad tracks. Moreover, sounds can be correlated within and across a communication system. For example, a passing train or a local thunderstorm can be correlated between two monitored locations.

Consider an example in which an IP phone is used as the acoustic sensing device (although it is imperative to note that any of the aforementioned endpoints could also be used). Further, consider a work premises scenario in which the environment is routinely vacated by the employees at night. During the non-work hour periods, the IP phone can be set such that it enters into a low-power mode in order to conserve energy. Even in this state, the IP phone continues to be viable, as it is kept functionally awake.

In this particular example scenario, the low-power state can be leveraged in order to periodically (or continuously) monitor the acoustic sound pressure level. If a detected sound is expected, then no action is taken. If an unanticipated sound is observed, one of many possible actions can ensue. In this example involving an uninhabited room with a nominal SPL of 15 dBA, noises outside this boundary can be flagged for further analysis. The classification of a sound as an 'unanticipated' or 'unexpected' means that the sound is uncharacteristic for its corresponding environment.

Hence, the IP phone is configured to sense sounds in excess of background noise levels. Whenever such a sound is observed, a low complexity analysis of the sound is performed on the IP phone itself to determine if it is a sound typical for its environment. Certain sound classifications may be too difficult for the IP phone to classify as 'anticipated' (or may require too much specialized processing to implement on the IP phone). If the IP phone is unable to make a definitive 'anticipated sound' assessment, the IP phone can forward the sound sample to a sound classification engine to make that determination. It should be noted that the sound classification could be a cloud service, provided on premises, or provisioned anywhere in the network.

Note that the methodology being outlined herein can scale significantly because the endpoints (in certain scenarios) can offload difficult sounds for additional processing. Thus, in a general sense, a nominal pre-processing stage is being executed in the IP phone. In many instances, a full time recording is not performed by the architecture. The endpoint can be configured to simply analyze the received sounds locally. It is only when a suspicious sound occurs that a recording could be initiated and/or sent for further analysis. Hence, when the sound is unrecognizable (e.g., too difficult to be analyzed locally) the sound can be recorded and/or sent to a separate sound classification engine for further analysis. Logistically, it should be noted that false alarms would uniformly be a function of a risk equation: the probability that a given stimulus will be a real (alarming) concern versus the downside risk of not alarming.

Before turning to some of the additional operations of communication system 10, a brief discussion is provided about some of the infrastructure of FIG. 1. Endpoints 12, 14, 16 are representative of devices used to initiate a communication, such as a telephone, a personal digital assistant (PDA), a Cius tablet, an iPhone, an iPad, an Android device, any other type of smartphone, any type of videophone or similar telephony device capable of capturing a video image, a conference bridge (e.g., those that sit on table tops and conference rooms), a laptop, a webcam, a Telepresence unit, or any other device, component, element, or object capable of initiating or exchanging audio data within communication system 10. Endpoints 12, 14, 16 may also be inclusive of a suitable interface to an end user, such as a microphone. Moreover, it should be appreciated that a variety of communication endpoints are illustrated in FIG. 1 to demonstrate the breadth and flexibility of communication system 10, and that in some embodiments, only a single communication endpoint may be deployed.

Endpoints 12, 14, 16 may also include any device that seeks to initiate a communication on behalf of another entity or element, such as a program, a database, or any other component, device, element, or object capable of initiating or exchanging audio data within communication system 10. Data, as used herein, refers to any type of video, numeric, voice, or script data, or any type of source or object code, or any other suitable information in any appropriate format that may be communicated from one point to another. Additional details relating to endpoints are provided below with reference to FIG. 2.

Network 18 represents a series of points or nodes of interconnected communication paths for receiving and transmitting packets of information that propagate through communication system 10. Network 18 offers a communicative interface between endpoints 12, 14, 16 and other network elements (e.g., security monitor 22), and may be any local area network (LAN), Intranet, extranet, wireless local area network (WLAN), metropolitan area network (MAN), wide area network (WAN), virtual private network (VPN), or any other appropriate architecture or system that facilitates communications in a network environment. Network 18 may implement a UDP/IP connection and use a TCP/IP communication protocol in particular embodiments of communication system 10. However, network 18 may alternatively implement any other suitable communication protocol for transmitting and receiving data packets within communication system 10. Network 18 may foster any communications involving services, content, video, voice, or data more generally, as it is exchanged between end users and various network elements.

Cloud network 20 represents an environment for enabling on-demand network access to a shared pool of computing resources that can be rapidly provisioned (and released) with minimal service provider interaction. It can provide computation, software, data access, and storage services that do not require end-user knowledge of the physical location and configuration of the system that delivers the services. A cloud-computing infrastructure can consist of services delivered through shared data-centers, which may appear as a single point of access. Multiple cloud components can communicate with each other over loose coupling mechanisms, such as a messaging queue. Thus, the processing (and the related data) is not in a specified, known, or static location. Cloud network 20 may encompasses any managed, hosted service that can extend existing capabilities in real time, such as Software-as-a-Service (SaaS), utility computing (e.g., storage and virtual servers), and web services.

As described herein, communication system 10 can have the sound analysis being performed as a service involving the cloud. However, there can be scenarios in which the same functionality is desired (i.e., decomposed, scalable, sound analysis), but where the non-localized analysis is kept on a given organization's premises. For example, certain agencies that have heightened confidentiality requirements may elect to have these sound classification activities entirely on their premises (e.g., government organizations, healthcare organizations, etc.). In such cases, security monitor 22 is on the customer's premises, where cloud network 20 would not be used.

Figure 2:
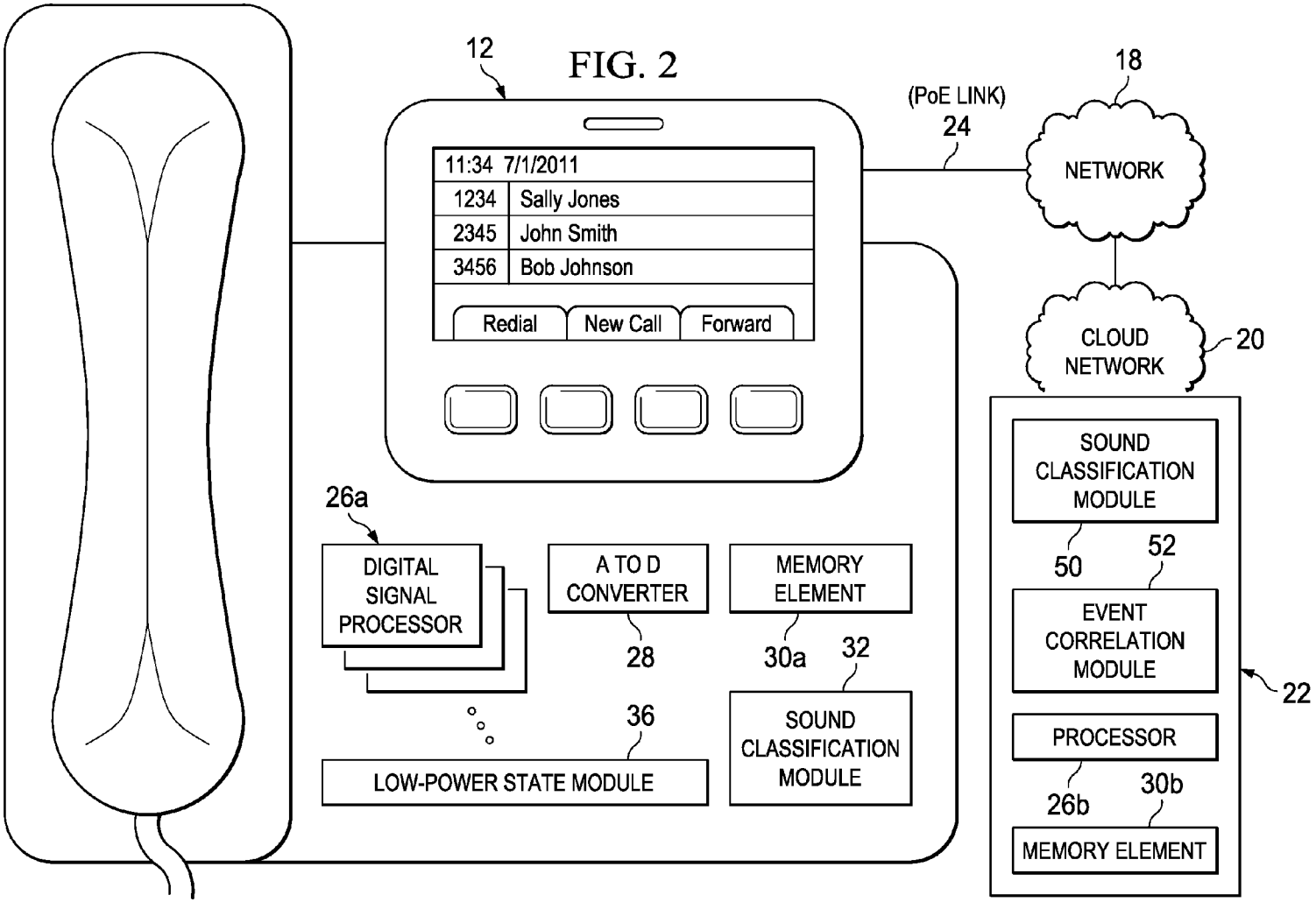
FIG. 2 is a simplified block diagram illustrating additional details that may be associated with an embodiment of the communication system.

Turning to FIG. 2, FIG. 2 is a simplified block diagram illustrating one possible set of details associated with endpoint 12 in communication system 10. In the particular implementation of FIG. 2, endpoint 12 may be attached to network 18 via a Power-over-Ethernet (PoE) link 24. As shown, endpoint 12 includes a digital signal processor (DSP) **26*a*, an analog-to-digital (A/D) converter 28, a memory element 30*a*, a local sound classification module 32, and a low-power state module 36**.

Endpoint 12 may also be connected to security monitor 22, through network 18 and cloud network 20, for example. In the example embodiment of FIG. 2, security monitor 22 includes a processor 26*b*, a memory element 30*b*, a sound classification module 50, and an event correlation module 52. Hence, appropriate software and/or hardware can be provisioned in endpoint 12 and/or security monitor 22 to facilitate the activities discussed herein. Any one or more of these internal items of endpoint 12 or security monitor 22 may be consolidated or eliminated entirely, or varied considerably, where those modifications may be made based on particular communication needs, specific protocols, etc.

Sound classification engine 32 can use any appropriate signal classification technology to further assess the unanticipated nature of the sound. Sound classification engine 32 has the intelligence to learn over time which sounds are 'typical' for the environment in which the IP phone is being provisioned. Hence, an air compressor sound in one location (location A) could be an anticipated sound, where this same sound would be classified as an unanticipated sound in location B. Over time, the classification can become more sophisticated (e.g., learning the times of such 'typical sound' events (e.g., trains passing by at a location near railroad tracks)). For example, certain weather patterns and geographic areas (e.g., thunderstorms in April in the Southeast) can be correlated to anticipated sounds such that false detections can be minimized.

In some scenarios, a data storage can be utilized (e.g., in the endpoint itself, provisioned locally, provisioned in the cloud, etc.) in order to store sound policies for specific locations. For example, a specific policy can be provisioned for a particular floor, a particular room, a building, a geographical area, etc. Such policies may be continually updated with the results of an analysis of new sounds, where such new sounds would be correlated to the specific environment in which the sound occurred. Note that new sounds (e.g., an HVAC noise) can be linked to proximate locations (if appropriate) such that a newly discovered sound in building #3, floor #15 could be populated across the policies of all endpoints on floor #15. Additionally, such policies may be continually updated with new response mechanisms that address detected security threats.

Upon such a sound being classified as interesting (typically an 'unanticipated sound'), a variety of other steps may be employed. For example, a human monitoring the system may decide to turn on the lights and/or focus cameras or other security assets toward the sound. These other assets may also include other IP phones and/or video phones. The inputs from other acoustic capture devices may be used to determine the location of the sound (e.g., via Direction of Arrival beam forming techniques), etc. Other response mechanisms can include recording the sound, and notifying an administrator, who could determine an appropriate response. For example, the notification can include e-mailing the recorded sound to an administrator (where the e-mail could include a link to the real-time monitoring of the particular room). Hence, security personnel, an administrator, etc. can receive a link to a video feed that is capturing video data associated with the location at which the sound anomaly occurred. Such notifications would minimize false alarms being detected, where human input would be solicited in order to resolve the possible security threat.

In certain scenarios, an automatic audio classification model may be employed by sound classification module 32. The automatic audio classification model can find the best-match class for an input sound by referencing it against a number of known sounds, and then selecting the sound with the highest likelihood score. In this sense, the sound is being classified based on previous provisioning, training, learning, etc. associated with a given environment in which the endpoints are deployed.

In reference to digital signal processor 26*a*, it should be noted that a fundamental precept of communication system 10 is that the DSP and acoustic inputs of such IP phones can be readily tasked with low-power acoustic sensing responsibilities during non-work hours. The IP phones can behave like sensors (e.g., as part of a more general and more comprehensive physical security arrangement). Logistically, most IP phone offerings are highly programmable (e.g., some are offered with user programmable applications) such that tasking the endpoints with the activities discussed herein is possible.

Advantageously, endpoints that are already being deployed for other uses can be leveraged in order to enhance security at a given site. Moreover, the potential for enhanced security could be significant because sound capture, unlike video capture, is not limited by line-of-sight monitoring. In addition, most of the acoustic inputs to typical IP phones are 16-bit capable with an additional analog gain stage prior to the analog-to-digital conversion. This allows for a dynamic range in excess 100 dB and a capture of sound to within ~20 dB of the threshold of hearing (i.e., capturing calm breathing at reasonable distances).

In regards to the internal structure associated with communication system 10, each of endpoints 12, 14, 16 and security monitor 22 can include memory elements (as shown in FIG. 2) for storing information to be used in achieving operations as outlined herein. Additionally, each of these devices may include a processor that can execute software or an algorithm to perform the activities discussed herein. These devices may further keep information in any suitable memory element (e.g., random access memory (RAM), read only memory (ROM), an erasable programmable read only memory (EPROM), application specific integrated circuit (ASIC), etc.), software, hardware, or in any other suitable component, device, element, or object where appropriate and based on particular needs. Any of the memory items discussed herein should be construed as being encompassed within the broad term 'memory element.' The information being tracked or sent by endpoints 12, 14, 16 and/or security monitor 22 could be provided in any database, queue, register, control list, or storage structure, all of which can be referenced at any suitable timeframe. Any such storage options may also be included within the broad term 'memory element' as used herein. Similarly, any of the potential processing elements, modules, and machines described herein should be construed as being encompassed within the broad term 'processor.' Each of endpoints 12, 14, 16, security monitor 22, and other network elements of communication system 10 can also include suitable interfaces for receiving, transmitting, and/or otherwise communicating data or information in a network environment.

In one example implementation, endpoints 12, 14, 16 and security monitor 22 may include software to achieve, or to foster, operations outlined herein. In other embodiments, these operations may be provided externally to these elements, or included in some other network device to achieve this intended functionality. Alternatively, these elements include software (or reciprocating software) that can coordinate in order to achieve the operations, as outlined herein. In still other embodiments, one or all of these devices may include any suitable algorithms, hardware, software, components, modules, interfaces, or objects that facilitate the operations thereof.

Note that in certain example implementations, functions outlined herein may be implemented by logic encoded in one or more tangible media (e.g., embedded logic provided in an ASIC, in DSP instructions, software (potentially inclusive of object code and source code) to be executed by a processor, or other similar machine, etc.). In some of these instances, memory elements (as shown in FIG. 2) can store data used for the operations described herein. This includes the memory elements being able to store software, logic, code, or processor instructions that are executed to carry out the activities described herein. A processor can execute any type of instructions associated with the data to achieve the operations detailed herein. In one example, the processors (as shown in FIG. 2) could transform an element or an article (e.g., data) from one state or thing to another state or thing. In another example, the activities outlined herein may be implemented with fixed logic or programmable logic (e.g., software/computer instructions executed by a processor) and the elements identified herein could be some type of a programmable processor, programmable digital logic (e.g., a field programmable gate array (FPGA), a DSP, an EPROM, EEPROM) or an ASIC that includes digital logic, software, code, electronic instructions, or any suitable combination thereof.

Figure 3:
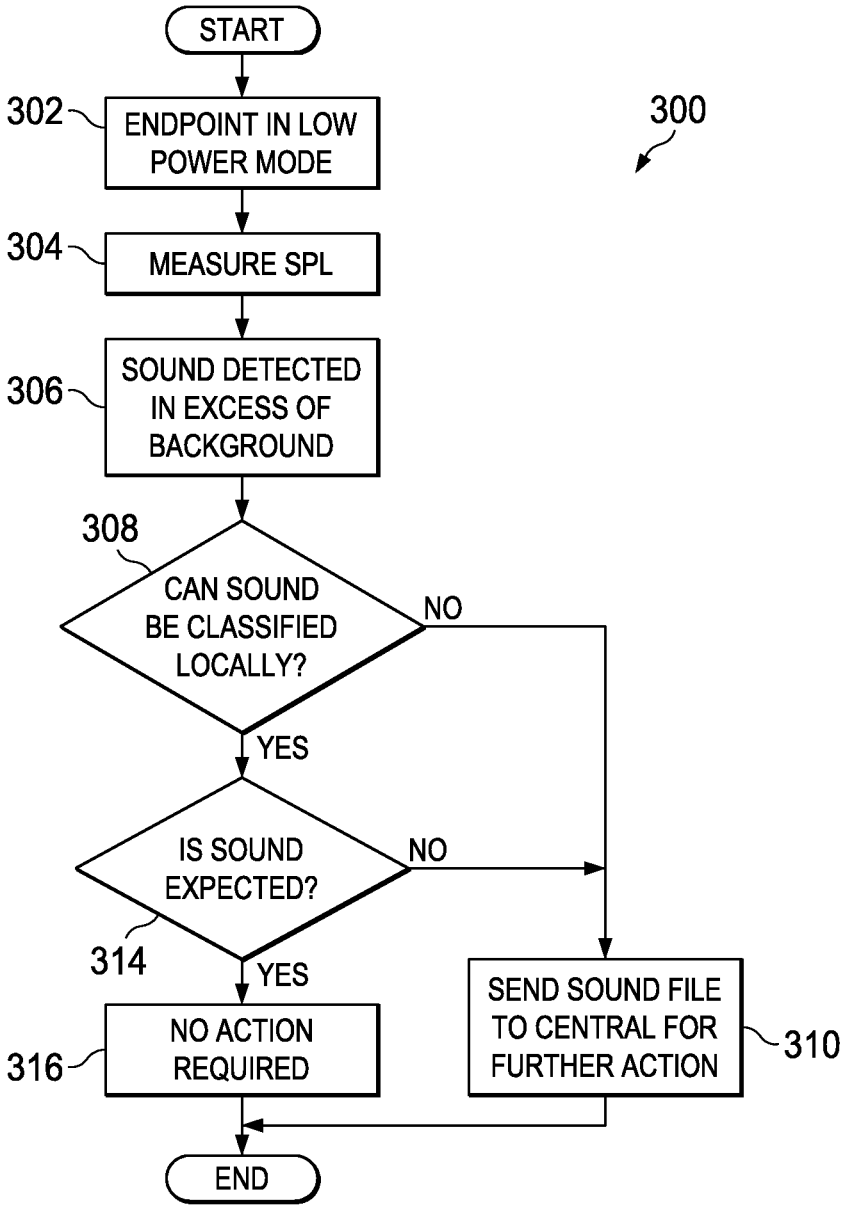
FIG. 3 is simplified flowchart that illustrates potential operations that may be associated with an embodiment of the communication system.

Turning to FIG. 3, FIG. 3 is simplified flowchart 300 that illustrates potential operations that may be associated with an example embodiment of communication system 10. Preliminary operations are not shown in FIG. 3, but such operations may include a learning phase, for example, in which a sound classification module collects samples of expected sounds over a given time period and stores them for subsequent analysis and comparison.

In certain embodiments, some operations may be executed by DSP 26*a*, A/D converter 28, local sound classification module 32, and/or low-power state module 36, for instance. Thus, a communication endpoint (e.g., an IP phone) may enter a low-power mode at 302, such as might occur after normal business hours at a large enterprise facility. In this low-power mode, an acoustic input device (e.g., a microphone) remains active and measures SPL at 304. Sound frames may also be collected and stored in a memory element, such as memory element 30*a*, as needed for additional processing. A sound frame generally refers to a portion of a signal of a specific duration. At 306, a change in nominal SPL (i.e., sound in excess of background noise) may be detected. Thus, for example, a sound frame may be collected, stored in a buffer, and analyzed to detect a change in nominal SPL. If no change is detected, the frame may be discarded. If a change is detected, additional frames may be collected and stored for further analysis.

If a sound that causes a change in nominal SPL cannot be classified locally (e.g., by sound classification module 32) at 308, then sound frames associated with the sound may be retrieved from memory and sent to a remote sound classification module (e.g., hosted by security monitor 22) for further analysis and possible action at 310. In other embodiments, however, all classification/processing may be done locally by a communication endpoint.

At any appropriate time interval, the remote security monitor may also update a sound database (after analysis) such that subsequent sounds with a similar spectral content can be classified more readily. The decision to update the sound database occurs outside of the flowchart processing of FIG. 3. In this sense, the decision to update can be asynchronous to the processing of FIG. 3. The endpoint would continue performing the sound analysis independent of the decision to update the database. The sound database may be located in the communication endpoint, in the remote security monitor, or both. In other embodiments, the sound database may be located in another network element accessible to the communication endpoint and/or the remote sound classification module.

For example, some sounds (e.g., sound from nearby construction) may be too complex to analyze with the processing capacity of an IP telephone. Nonetheless, these sounds may be collected and stored temporarily as frames in a buffer for pre-processing by the IP telephone. Spectral content of the sound waveform (e.g., amplitude envelope, duration, etc.) can be compared to known waveforms stored in a memory, for example, and if a similar waveform is not identified, the sound frames may then be sent to a remote sound classification module, which may have significantly more processing capacity for analyzing and classifying the waveform. The remote sound classification module may determine that a locally unrecognized sound is benign (e.g., based on correlation with a similar sound in another location, or through more complex analytical algorithms) and take no action, or it may recognize the sound as a potential threat and implement certain policy actions.

If the sound that caused the change in nominal SPL can be classified locally at 308, then it is classified at 314. If the sound is not an expected sound (e.g., a voice), then the sound can be sent to a central location (e.g., a remote security monitor) for further action at 310. If the sound is expected, then no action is required at 316.

Figure 4:
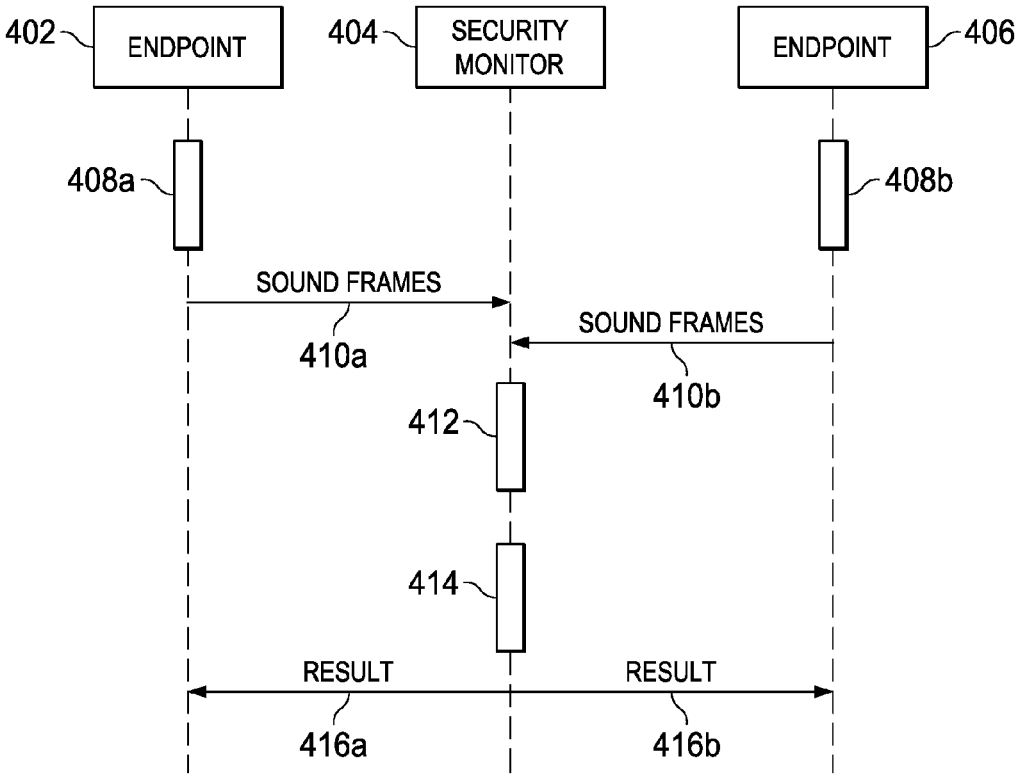
FIG. 4 is a simplified sequence diagram that illustrates potential operations that may be associated with another embodiment of the communication system.

FIG. 4 is a simplified sequence diagram that illustrates potential operations that may be associated with one embodiment of communication system 10 in which sounds from different locations can be correlated. This example embodiment includes a first endpoint 402, a security monitor 404, and a second endpoint 406. At 408*a* and 408*b*, endpoint 402 and 406 may detect a sound anomaly and transmit sound frames associated with the sound anomaly at 410*a*-410*b*, respectively. Security monitor 404 can receive the sound frames and classify them at 412. Security monitor 404 may additionally attempt to correlate the sound frames at 414.

In one embodiment, for example, security monitor 404 can compare time stamps associated with the sound frames, or the time at which sounds were received. If the timestamps (associated with sound frames) received from endpoint 402 are within a configurable threshold time differential of the time stamps or time received associated with sound frames received from endpoint 406, security monitor may compare the frames to determine if the sounds are similar. At 416*a*-416*b*, security monitor 404 may send results of the classification and/or correlation to endpoint 402 and endpoint 406, respectively, or may send instructions for processing subsequent sounds having a similar sound profile.

In general, endpoint 402 and endpoint 406 can be geographically distributed across a given area, although the distance may be limited by the relevance of sounds across such a distance. For example, if endpoint 402 is located across town from endpoint 406 and a thunderstorm is moving through the area, endpoint 402 and endpoint 406 may both detect the sound of thunder at approximately the same time. The sound of thunder may be recognized by a sound classification module hosted by security monitor 404, and since thunderstorms can often envelop entire cities at once, these sounds may be correlated to facilitate better recognition (or provide a higher degree of certainty). Endpoint 402 and endpoint 406 may then be instructed to ignore similar sounds for a given duration. In another example, endpoint 402 and endpoint 406 may both detect the sound of a train nearby at approximately the same time. If endpoint 402 and endpoint 406 are across the street, then the sounds may be correlated and, further, provide useful information to security monitor. However, if the sounds are across town, attempting to correlate the same sound may provide meaningless information to the system, unless the correlation is further augmented with schedules that are known or learned.

Figure 5:
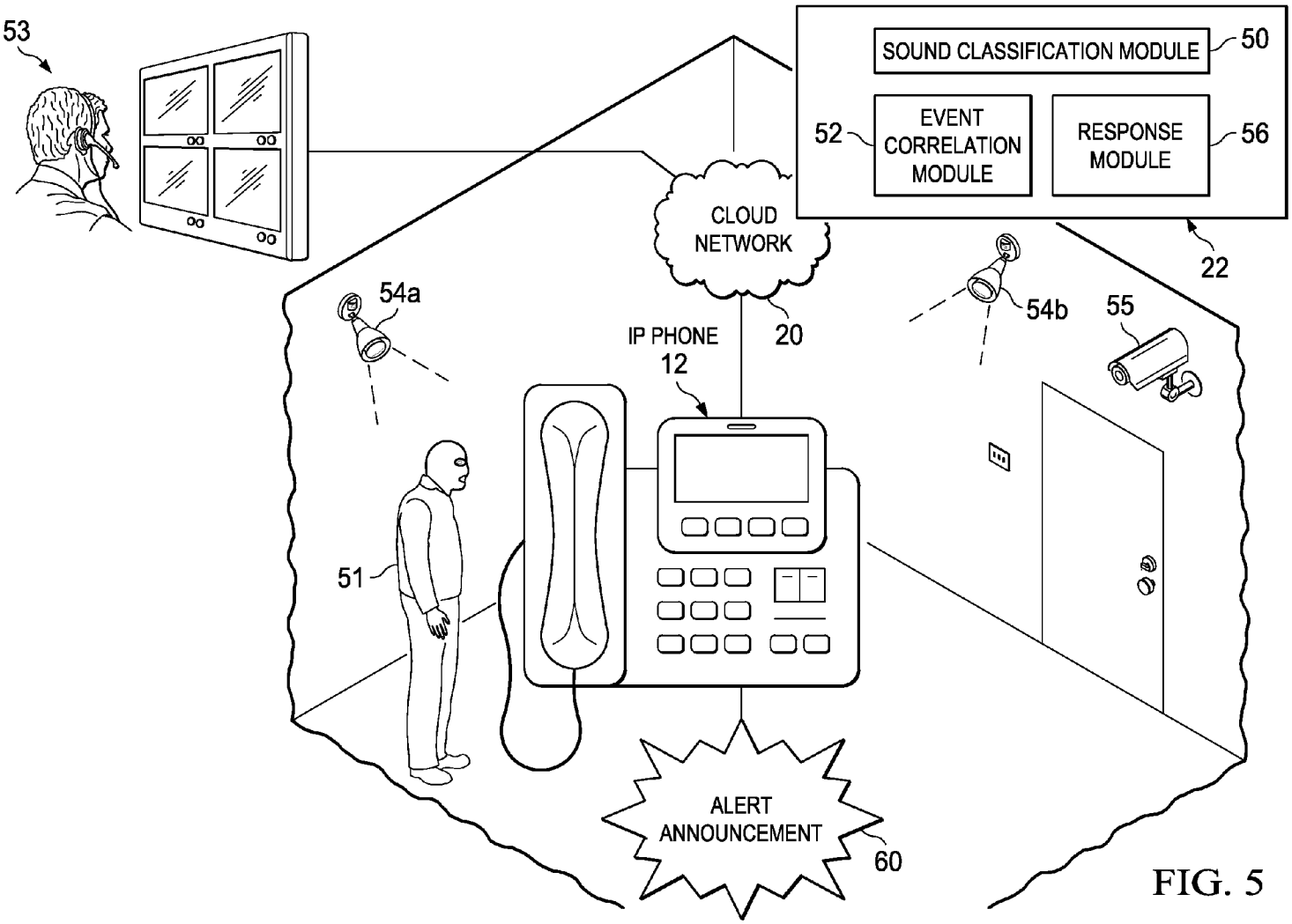
FIG. 5 is a simplified schematic diagram illustrating potential actions that may be employed in an example embodiment of the communication system.

FIG. 5 is a simplified schematic diagram that illustrates some of the actions that may be employed by communication system 10 upon detecting a sound anomaly in one scenario. For example, if an intruder 51 produces a sound anomaly, security personnel 53 may be alerted, a set of lights 54*a*-54*b* activated, a camera 55 focused, an alert announcement 60 broadcasted, or other security assets can be directed toward the sound. Other security assets may include, for example, other IP telephones, videophones, and other communication endpoints. As used herein in this Specification, the term 'security asset' is meant to encompass any of the aforementioned assets, and any other appropriate device that can assist in determining the degree of a possible security threat. In some embodiments, inputs from other acoustic capture devices (e.g., communication endpoints) may also be used to determine the location of the sound, using direction of arrival beam forming techniques, for example.

Note that in certain instances, classification module 50, response module 56 and/or the event correlation module 52 may reside in the cloud or be provisioned directly in the enterprise. This latter enterprise case could occur for an enterprise large enough to warrant its own system. In the former case involving the cloud scenario, a hosted security system could be employed for a particular organization.

In more particular embodiments, different levels of actions may be implemented based on predefined security policies in a response module 56. For example, if a voice is detected in an unsecured office, response module 56 may only activate lights 54*a*-54*b*, begin recording a video stream from camera 55, or both. Other alternatives may include panning, tilting, and zooming camera 55 (to further evaluate the security threat), along with alerting security personnel 53. In a secure office, though, the response may be more drastic, such as locking the exits. Hence, a first level of security (e.g., a default setting) may involve simply turning on the lights, playing an announcement on the endpoint, and locking a door. It should be noted that the tolerance for false alarms can be directly correlated to the response mechanism.

Note that with the examples provided above, as well as numerous other examples provided herein, interaction may be described in terms of two, three, or four network elements. However, this has been done for purposes of clarity and example only. In certain cases, it may be easier to describe one or more of the functionalities of a given set of flows by only referencing a limited number of endpoints. It should be appreciated that communication system 10 (and its teachings) are readily scalable and can accommodate a large number of components, as well as more complicated/sophisticated arrangements and configurations. Accordingly, the examples provided should not limit the scope or inhibit the broad teachings of communication system 10 as potentially applied to a myriad of other architectures. Additionally, although described with reference to particular scenarios, where a module is provided within the endpoints, these elements can be provided externally, or consolidated and/or combined in any suitable fashion. In certain instances, certain elements may be provided in a single proprietary module, device, unit, etc.

It is also important to note that the steps in the appended diagrams illustrate only some of the possible signaling scenarios and patterns that may be executed by, or within, communication system 10. Some of these steps may be deleted or removed where appropriate, or these steps may be modified or changed considerably without departing from the scope of teachings provided herein. In addition, a number of these operations have been described as being executed concurrently with, or in parallel to, one or more additional operations. However, the timing of these operations may be altered considerably. The preceding operational flows have been offered for purposes of example and discussion. Substantial flexibility is provided by communication system 10 in that any suitable arrangements, chronologies, configurations, and timing mechanisms may be provided without departing from the teachings provided herein.

Numerous other changes, substitutions, variations, alterations, and modifications may be ascertained to one skilled in the art and it is intended that the present disclosure encompass all such changes, substitutions, variations, alterations, and modifications as falling within the scope of the appended claims. In order to assist the United States Patent and Trademark Office (USPTO) and, additionally, any readers of any patent issued on this application in interpreting the claims appended hereto, Applicant wishes to note that the Applicant: (a) does not intend any of the appended claims to invoke paragraph six (6) of 35 U.S.C. section 112 as it exists on the date of the filing hereof unless the words "means for" or "step for" are specifically used in the particular claims; and (b) does not intend, by any statement in the specification, to limit this disclosure in any way that is not otherwise reflected in the appended claims.

What is claimed is:

1. A method, comprising:

monitoring a sound pressure level with an endpoint, wherein the endpoint is an Internet Protocol telephone;

analyzing the sound pressure level to detect a sound anomaly;

referencing the sound anomaly against a plurality of sounds to identify one of the plurality of sounds based on a likelihood score; and communicating the sound anomaly to a remote sound classification module if the one of the plurality of sounds is not identified.

2. The method of claim 1, wherein a local sound classification module is hosted by the endpoint.

3. The method of claim 1, wherein the remote sound classification module is hosted in a cloud network.

4. The method of claim 1, further comprising:

provisioning the remote sound classification module on premises that are local to the endpoint.

5. The method of claim 1, further comprising:

accessing a sound database that includes a policy associated with an environment in which the endpoint resides; and updating the sound database to include a signature associated with the sound anomaly.

6. The method of claim 1, further comprising:

evaluating the sound anomaly at the remote sound classification module;

monitoring a location in response to the sound anomaly, using a security asset; and recording an activity at the location.

7. The method of claim 1, further comprising:

correlating the sound anomaly with a sound anomaly detected by an additional endpoint.

8. The method of claim 1, wherein the sound anomaly is classified based, at least in part, on an environment in which the sound anomaly occurred.

9. The method of claim 1, further comprising:

provisioning a second sound classification module in a network to receive sound anomalies sent by the endpoint.

10. The method of claim 1, wherein the endpoint is powered over Ethernet.

11. The method of claim 1, wherein the communicating communicates the sound anomaly to the remote sound classification module in response to a determination that a spectral content of the sound anomaly is not similar to a waveform stored in the endpoint.

12. The method of claim 1, wherein the endpoint operates in a low-power mode during the monitoring.

13. The method of claim 1, further comprising:

comparing a first time at which the sound anomaly was received and a second time at which a sound was received.

14. One or more non-transitory media that includes code for execution and, when executed by a processor, to perform operations comprising:

monitoring a sound pressure level with an endpoint, wherein the endpoint is an Internet Protocol telephone;

analyzing the sound pressure level to detect a sound anomaly;

referencing the sound anomaly against a plurality of sounds to identify one of the plurality of sounds based on a likelihood score; and communicating the sound anomaly to a remote sound classification module if the one of the plurality of sounds is not identified.

15. The non-transitory media in claim 14, the operations further comprising:

accessing a sound database that includes a policy associated with an environment in which the endpoint resides; and updating the sound database to include a signature associated with the sound anomaly.

16. The non-transitory media in claim 14, the operations further comprising:

evaluating the sound anomaly at the sound classification module;

monitoring a location in response to the sound anomaly, using a security asset; and recording an activity at the location.

17. The non-transitory media in claim 14, wherein the sound anomaly is classified based, at least in part, on an environment in which the sound anomaly occurred.

18. An endpoint, comprising:

a memory element configured to store electronic code;

a processor operable to execute instructions associated with the electronic code; and a sound classification module coupled to the memory element and the processor, wherein the endpoint is an Internet Protocol telephone configured to monitor a sound pressure level; and the endpoint is further configured to analyze the sound pressure level to detect a sound anomaly, to reference the sound anomaly against a plurality of sounds to identify one of the plurality of sounds based on a likelihood score, and to communicate the sound anomaly to a remote sound classification module if the one of the plurality of sounds is not identified.

19. The endpoint of claim 18, wherein the sound anomaly is classified based, at least in part, on an environment in which the sound anomaly occurred.

20. The endpoint of claim 18, wherein a notification is sent based on the sound anomaly, the notification including a link to video information associated with a location in which the sound anomaly occurred.

* * * * *